US010898949B2

(12) United States Patent
Dahlgren

(10) Patent No.: US 10,898,949 B2
(45) Date of Patent: Jan. 26, 2021

(54) TECHNIQUES AND APPARATUS FOR ELECTROMAGNETICALLY STIRRING A MELT MATERIAL

(71) Applicant: Glassy Metals LLC, Cambridge, MA (US)

(72) Inventor: Eric Dahlgren, Boston, MA (US)

(73) Assignee: GLASSY METALS LLC, Cambridge, MA (US)

( * ) Notice: Subject to any disclaimer, the term of this patent is extended or adjusted under 35 U.S.C. 154(b) by 220 days.

(21) Appl. No.: 15/967,887

(22) Filed: May 1, 2018

(65) Prior Publication Data

US 2018/0318920 A1 Nov. 8, 2018

Related U.S. Application Data

(60) Provisional application No. 62/502,176, filed on May 5, 2017.

(51) Int. Cl.
*F27D 3/00* (2006.01)
*F27D 27/00* (2010.01)
(Continued)

(52) U.S. Cl.
CPC ..... *B22D 27/02* (2013.01); *B01F 13/0809* (2013.01); *F27D 11/04* (2013.01);
(Continued)

(58) Field of Classification Search
CPC ..... B22D 27/02; B01F 13/0809; B01F 2215/0044; F27D 11/00; F27D 11/02;
(Continued)

(56) References Cited

U.S. PATENT DOCUMENTS 3,735,010 A * 5/1973 Turpin ..... F27B 3/085 373/76
4,214,286 A 7/1980 Ragle et al.
(Continued)

OTHER PUBLICATIONS

Takuya Tamura et al., "Electromagnetic vibration process for producing bulk metallic glasses", Nature Publishing Group, Published online: Mar. 6, 2005; doi; 10.1038/nmat134, Nature Materials, vol. 4, Apr. 2005, www.nature.com/naturematerals, pp. 289-292, 4 pages.
(Continued)

*Primary Examiner* — Hung D Nguyen
(74) *Attorney, Agent, or Firm* — Hayes Soloway PC

(57) ABSTRACT

Techniques and apparatus for electromagnetically stirring a melt material are disclosed. In accordance with some embodiments, the system may include a containment vessel within which a melt material may be disposed. The melt material may include, for example, an electrically conductive alloy, which optionally may be non-ferromagnetic and/or glass-forming. In its molten state, the melt material may have alternating current (AC) applied directly thereto while being immersed in a magnetic field, which may be static or dynamic, depending on the desired stirring effect. Application of the AC and magnetic field may continue as the melt material cools and solidifies, the sinusoidal nature of the AC and the Lorentz force of the magnetic field providing convective motion which tends to agitate the molten melt material in a manner which may realize an improvement in heat transfer and chemical homogeneity of the resultant cast solid.

20 Claims, 5 Drawing Sheets

(51) Int. Cl.

| | |
|---|---|
| ***B22D 27/02*** | (2006.01) |
| ***B01F 13/08*** | (2006.01) |
| ***F27D 11/04*** | (2006.01) |
| *F27B 14/08* | (2006.01) |

(52) U.S. Cl.
CPC ..... *F27D 27/00* (2013.01); *B01F 2215/0044* (2013.01); *F27B 2014/0887* (2013.01)

(58) Field of Classification Search
CPC ..... F27D 11/04; F27D 27/00; F27D 27/005; F27B 2014/0887
USPC ..... 373/109, 113, 116, 117, 118, 120, 122, 373/128, 130, 137, 85, 146
See application file for complete search history.

(56) References Cited

U.S. PATENT DOCUMENTS 4,351,057 A * 9/1982 Biolik ..... H05B 3/62 373/117
4,606,037 A 8/1986 Terashima et al.
4,845,328 A 7/1989 Storm et al.
5,158,750 A 10/1992 Finicle
5,427,173 A 6/1995 Das et al.
5,563,904 A 10/1996 Colpo et al.
5,740,854 A 4/1998 Inoue et al.
5,762,865 A 6/1998 Kimura et al.
6,427,753 B1 8/2002 Inoue et al.
7,444,837 B2 11/2008 Romer et al.
7,972,556 B2 7/2011 Araseki et al.
8,496,046 B2 7/2013 Nakayama et al.
8,721,789 B2 5/2014 Eriksson et al.
8,944,142 B2 2/2015 Nikrityuk et al.
8,986,469 B2 3/2015 Vecchio et al.
9,333,556 B2 5/2016 Kurosawa et al.
RE46,136 E 9/2016 Mariner et al.
9,477,521 B2 10/2016 Truong et al.
9,534,314 B2 1/2017 Choi et al.
2004/0070121 A1* 4/2004 Ohnsmann ..... B22D 18/04 266/166
2007/0107467 A1 5/2007 Miwa et al.
2009/0020925 A1* 1/2009 Takahashi ..... C22B 9/003 266/234
2009/0322000 A1* 12/2009 Takahashi ..... H05B 6/34 266/234
2010/0050932 A1* 3/2010 Stoddard ..... C30B 11/003 117/73
2011/0243180 A1* 10/2011 Kolberg ..... C03B 5/021 373/142
2016/0108484 A1 4/2016 Preston et al.
2017/0003077 A1* 1/2017 Takahashi ..... B22D 11/115

OTHER PUBLICATIONS

Moffatt, "Electromagnetic stirring", Physics of Fluids A: Fluid Dynamics, vol. 3, Issue 5 > 10.1063/1.858062, Department of Applied Mathematics and Theoretical Physics, University of Cambridge, Cambridge England, Published online: Jun. 1998, Accepted: Dec. 1990, 8 pages.

* cited by examiner

TECHNIQUES AND APPARATUS FOR ELECTROMAGNETICALLY STIRRING A MELT MATERIAL

CROSS-REFERENCE TO RELATED APPLICATION

This patent application claims the benefit of U.S. Provisional Patent Application No. 62/502,176, filed on May 5, 2017, and titled "Techniques and Apparatus for Electromagnetically Stirring a Melt Material," which is herein incorporated by reference in its entirety.

FIELD OF THE DISCLOSURE

The present disclosure relates to metal and alloy processing and more particularly to melt material processing.

BACKGROUND

Casting is a metalworking process in which molten metal is dispensed into a mold of a given desired shape. Within the mold, the molten metal cools and solidifies as a cast solid. Casting processes are used in a wide range of contexts and applications, including machine component fabrication, construction materials fabrication, automobile manufacturing, tool making, and jewelry making, to name a few.

SUMMARY

The subject matter of this application may involve, in some cases, interrelated products, alternative solutions to a particular problem, and/or a plurality of different uses of a single system or article.

One example embodiment provides a melt material processing system. The system includes a containment vessel configured to contain a melt material including an electrically conductive alloy. The system also includes at least one electrode configured to: be in direct physical contact with the melt material within the containment vessel; and apply an alternating current (AC) directly to the melt material. The system further includes a magnetic field source configured to apply a magnetic field to the melt material within the containment vessel.

In some cases, the containment vessel is of at least one of a cylindrical geometry and a rectangular prismatic geometry. In some instances, the containment vessel includes at least one of copper (Cu), austenitic stainless steel, and graphite. In some cases, the containment vessel includes at least one exterior channel configured to pass a coolant therethrough. In some instances, the electrically conductive alloy is an aluminum (Al)-based alloy. In some other instances, the electrically conductive alloy is a copper (Cu)-based alloy.

In some cases, the system further includes at least one electrically insulating layer disposed within the containment vessel, over at least a portion of an interior surface of the containment vessel, such that the at least one electrically insulating layer intervenes between the melt material and the interior surface of the containment vessel. In some such cases, the at least one electrically insulating layer is a coating disposed on the interior surface of the containment vessel. In some other such cases, the at least one electrically insulating layer is a removable insert configured to be inserted within the containment vessel. In some instances, the at least one electrically insulating layer includes a ceramic material. In some instances, the at least one electrically insulating layer includes at least one of aluminum nitride (AlN) and pyrolytic boron nitride (PBN).

In some cases, the system further includes a power supply configured to: be in electrical communication with the at least one electrode; and supply AC of a frequency in the range of about 1-1,000 Hz. In some instances, the at least one electrode includes graphite. In some cases, the magnetic field source includes at least one permanent magnet. In some other cases, the magnetic field source includes at least one direct current (DC) electromagnet. In some instances, the magnetic field source is configured to rotate along at least one of: a central axis of the containment vessel; and a central axis of the magnetic field source.

Another example embodiment provides a method of processing a melt material. The method includes heating the melt material to a molten state within a containment vessel, the melt material including an electrically conductive alloy. The method also includes, prior to allowing the molten melt material to cool, stirring the molten melt material by simultaneously: applying alternating current (AC) directly to the molten melt material via at least one electrode in direct physical contact with the molten melt material; and applying a magnetic field to the molten melt material. The method further includes allowing the molten melt material to cool while maintaining application thereto of the AC and the magnetic field.

In some cases, the containment vessel is of at least one of a cylindrical geometry and a rectangular prismatic geometry. In some instances, the containment vessel includes at least one of copper (Cu), austenitic stainless steel, and graphite. In some cases, the containment vessel includes at least one exterior channel configured to pass a coolant therethrough. In some instances, the electrically conductive alloy is an aluminum (Al)-based alloy. In some other instances, the electrically conductive alloy is a copper (Cu)-based alloy. In some cases, the AC is of a frequency in the range of about 1-1,000 Hz. In some instances, the at least one electrode includes graphite. In some cases, the magnetic field is applied via at least one permanent magnet. In some other cases, the magnetic field is applied via at least one direct current (DC) electromagnet.

In some instances, applying the magnetic field to the molten melt material includes: rotating a source of the magnetic field along at least one axis. In some such instances, the at least one axis is a central axis of the containment vessel. In some other such instances, the at least one axis is a central axis of the source of the magnetic field.

In some cases, allowing the molten melt material to cool includes: quenching the molten melt material by applying a coolant to at least a portion of an exterior of the containment vessel. In some such cases, the coolant includes at least one of water, steam, alcohol, and oil.

In some instances, a product formed via the disclosed method is provided.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
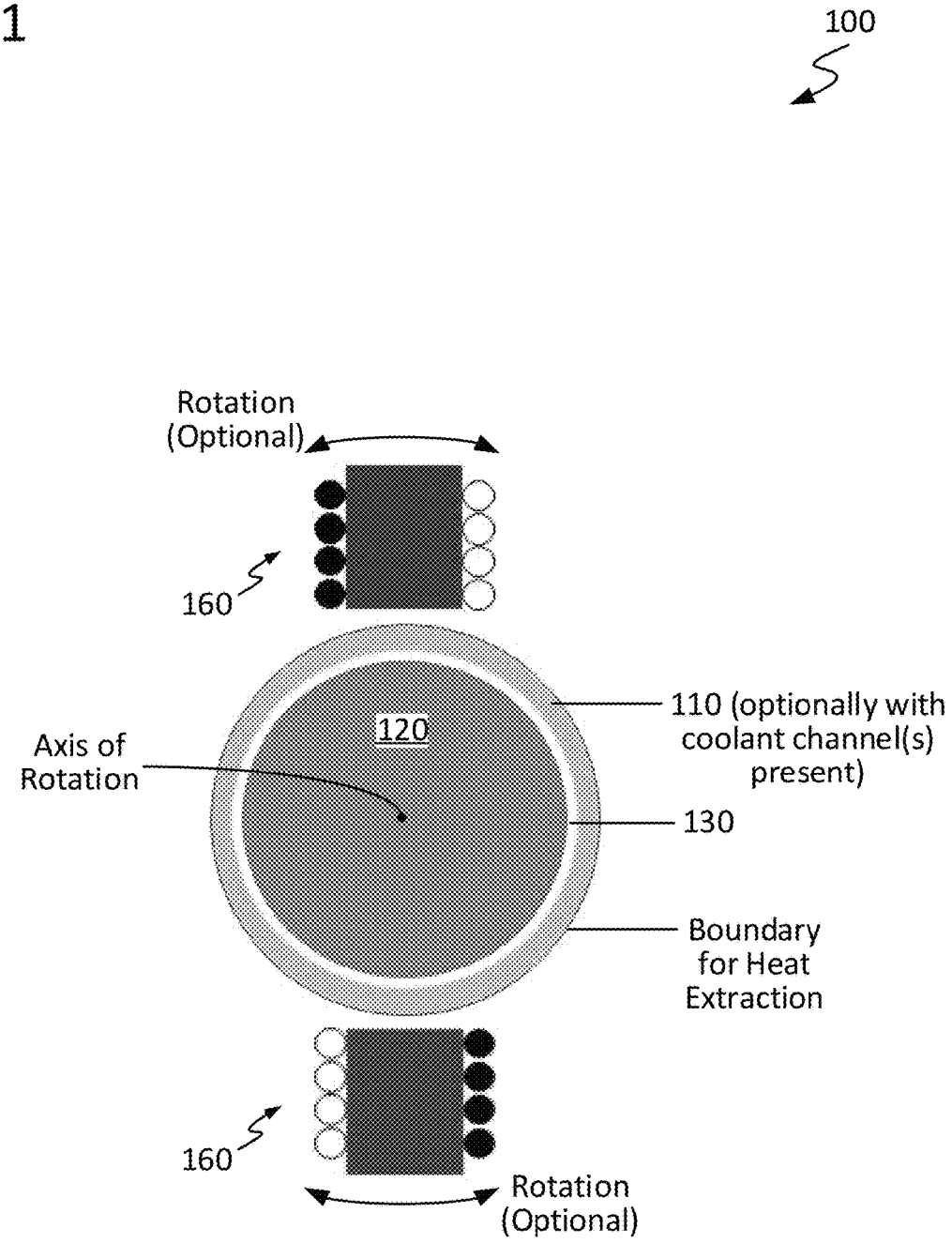
FIG. 1 is a cross-sectional top-down plan view of a melt material processing system configured in accordance with an embodiment of the present disclosure.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated in light of this disclosure, the accompanying drawings are not intended to be drawn to scale or to limit the described embodiments to the specific configurations shown.

DETAILED DESCRIPTION

Techniques and apparatus for electromagnetically stirring a melt material are disclosed. In accordance with some embodiments, the system may include a containment vessel within which a melt material may be disposed. The melt material may include, for example, an electrically conductive alloy, which optionally may be non-ferromagnetic and/or glass-forming. In its molten state, the melt material may have alternating current (AC) applied directly thereto while being immersed in a magnetic field, which may be static or dynamic, depending on the desired stirring effect. Application of the AC and magnetic field may continue as the melt material cools and solidifies, the sinusoidal nature of the AC and the Lorentz force of the magnetic field providing convective motion which tends to agitate the molten melt material in a manner which may realize an improvement in heat transfer and chemical homogeneity of the resultant cast solid. Numerous configurations and variations will be apparent in light of this disclosure.

General Overview

When casting metallic parts, either in end-shape or for further downstream forging or other treatment, it is generally desirable to maintain chemical homogeneity of the solidifying melt while also achieving fast solidification rates. Unlike pure metal systems, which have a distinct melting/freezing point, alloy systems melt/freeze over a temperature range. Thus, when an alloy melt is solidifying, there is a solidification zone separating the newly formed solid and the hotter liquid. With a temperature gradient over this solidifying zone, there are thermodynamic forces resulting in differential transport of the various chemical constituents to or from the solidification front. In a worst-case scenario, this transport is of such magnitude and over such a significant length scale that the inhomogeneity of the chemical composition is impossible to correct by downstream heat treatment of the solid, rendering a failed casting. In addition, a higher cooling rate of the system (meaning faster solidification rates) generally results in a finer structure, characterized by smaller grain sizes and/or a finer dendritic structure. Comparing isotropically structured solids, a finer structure generally results in a stronger material. Thus, chemical homogeneity and a fine structure are, from a solidification point of view, linked phenomena, and both are desirable in most metallic castings.

When an undisturbed or quiescent melt is cooled, heat is extracted at one or more surfaces of the system. This heat extraction is accompanied by internal heat conduction in the liquid transporting heat from the center of the system to the surfaces. This thermal transport is described by Fourier's law, represented here:

$$q=-k\nabla T,$$

where q is the heat transported ($W/m^2$), $\nabla T$ is the local temperature gradient (K/m), and k is the material-specific thermal conductivity (W/mK). As an example, liquid copper (Cu) has a thermal conductivity of approximately 170 W/mK, whereas many alloy melts have a thermal conductivity of 30 W/mK or less. Thus, to conductively transfer the same amount of heat, the alloy system must accommodate a thermal gradient more than six times as steep as compared to the example pure Cu system.

In addition to these non-trivial issues for alloy systems, it is noteworthy that an alternating current (AC) is distributed unevenly in a conductor, tending to focus near the surface of the conductor. This phenomenon, known as the skin effect, is a fundamental aspect of time-varying currents in conductors. The skin depth ($\delta$) describes how the AC is distributed in the conductor and is the depth into the conductor where the current density has been attenuated to about one-third of its highest value at the surface of the conductor. The skin depth is a function of the frequency (f) of the time-varying current, the electrical conductivity ($\sigma$), and the magnetic permeability ($\mu$) of the conductor according to the following:

$$\delta = \frac{1}{\sqrt{\pi f \sigma \mu}}.$$

Thus, by increasing the frequency of the applied current, the current is forced to flow in a narrower segment near the surface of the conductor.

In a current-carrying medium, power is dissipated in the form of heat. This phenomenon, known as Joule heating, is a fundamental aspect of the flow of electric current. With a local current density (j), in amperes per unit area, the amount of heat developed per unit volume (P) is given by the following relationship:

$$P = \frac{j^2}{\sigma}.$$

Thus, and in accordance with some embodiments of the present disclosure, techniques and apparatus for electromagnetically stirring a melt material are disclosed. In accordance with some embodiments, the system may include a containment vessel within which a melt material may be disposed. The melt material may include, for example, an electrically conductive alloy, which optionally may be non-ferromagnetic and/or glass-forming. In its molten state, the melt material may have alternating current (AC) applied directly thereto while being immersed in a magnetic field, which may be static or dynamic, depending on the desired stirring effect. Application of the AC and magnetic field may continue as the melt material cools and solidifies, the sinusoidal nature of the AC and the Lorentz force of the magnetic field providing convective motion which tends to agitate the molten melt material in a manner which may realize an improvement in heat transfer and chemical homogeneity of the resultant cast solid.

When exposed to a magnetic field, a current-carrying melt material experiences a Lorentz force density (F), which can be formulated as the following:

$$F=j\times B,$$

where B is the magnetic field vector, and j is the current density vector. This vector product means that the force (density) is normal to both the current and the applied magnetic field. The magnitude of this force is greatest when, in turn, the current is normal to the magnetic field and then can be written as the following:

$$F=jB,$$

where all values are now scalar. Therefore, by subjecting an electrically conductive melt material to AC of an appropriate frequency in one direction and applying a static (or, optionally, spatially oscillating) magnetic field transversely to the AC, convective motion in the molten melt material may arise, in accordance with some embodiments. Such currents will stir the molten portion of the melt, which will reduce both thermal and chemical gradients in the overall melt, as compared to the quiescent case. Moreover, by applying a stronger magnetic field, the magnitude of the current and, consequently, Joule heating may be reduced while keeping the Lorentz force density constant, in accordance with some embodiments. As will be appreciated in light of this disclosure, the disclosed techniques and apparatus may be used in any of a wide range of metal casting contexts and applications.

System Architecture and Operation

Figure 2:
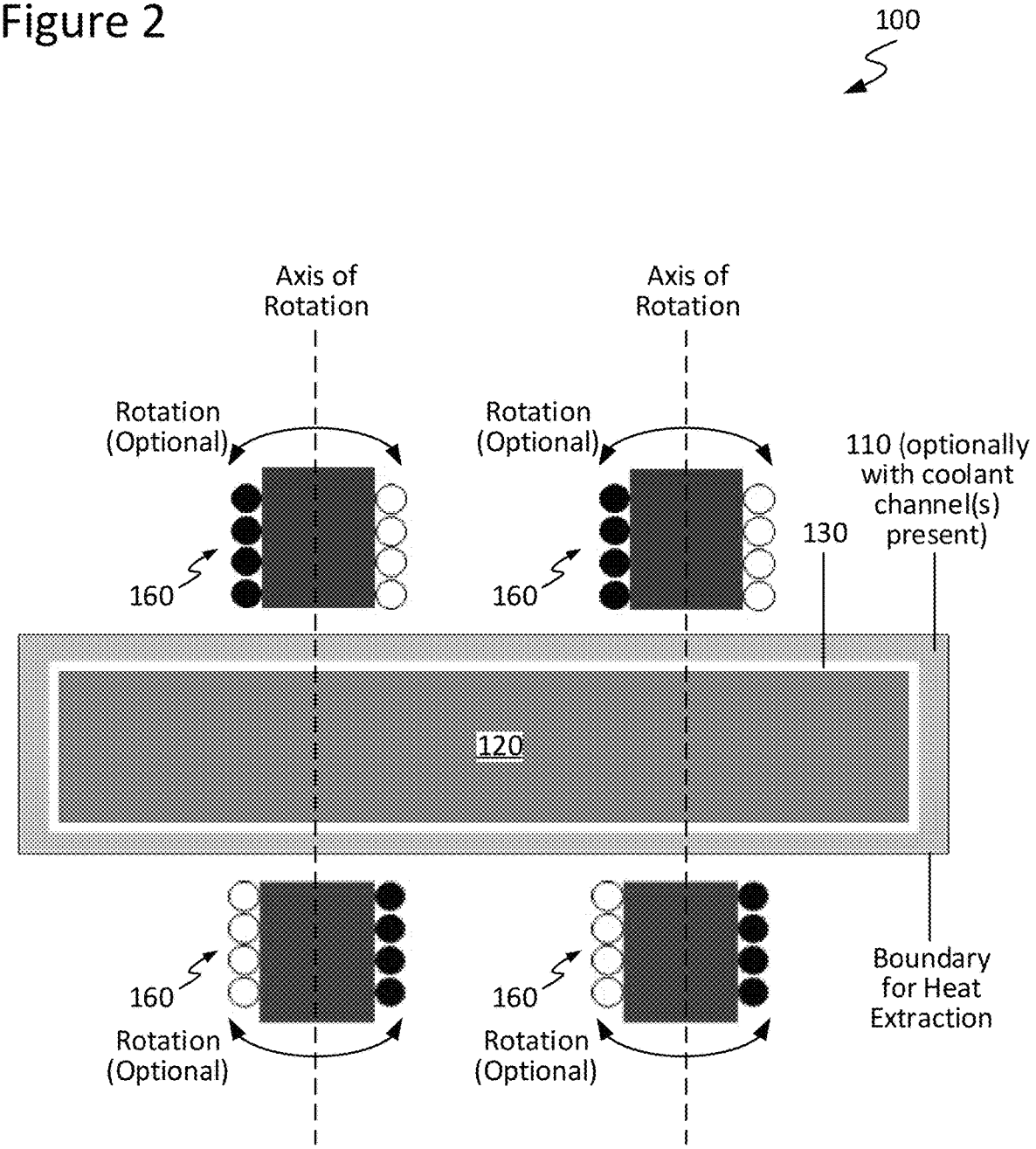
FIG. 2 is a cross-sectional top-down plan view of a melt material processing system configured in accordance with another embodiment of the present disclosure.
Figure 3:
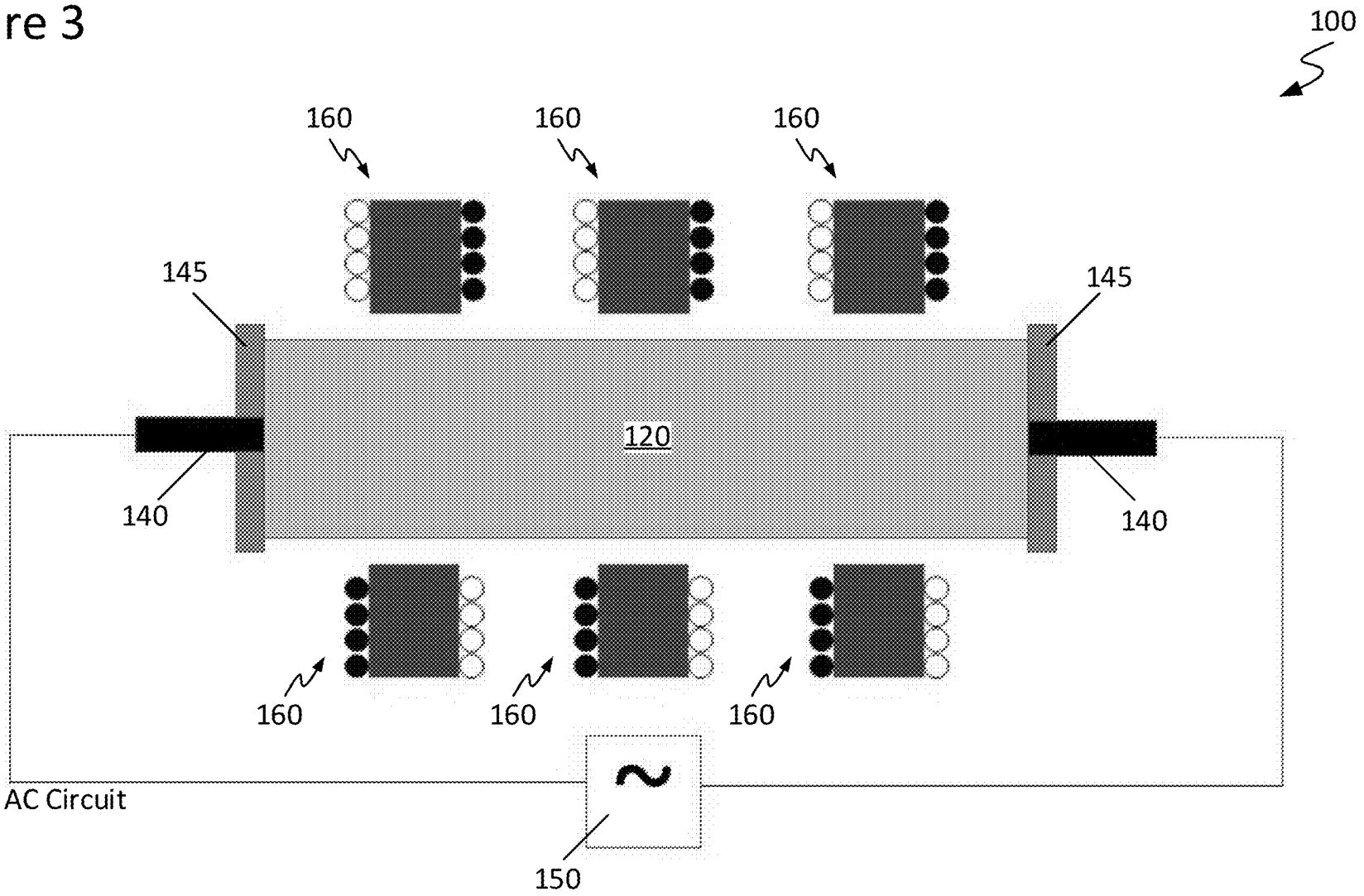
FIG. 3 is a cross-sectional side elevation view of a melt material processing system configured in accordance with another embodiment of the present disclosure.

FIG. 1 is a cross-sectional top-down plan view of a melt material processing system 100 configured in accordance with an embodiment of the present disclosure. FIG. 2 is a cross-sectional top-down plan view of a melt material processing system 100 configured in accordance with another embodiment of the present disclosure. FIG. 3 is a cross-sectional side elevation view of a melt material processing system 100 configured in accordance with another embodiment of the present disclosure.

As can be seen from these figures, system 100 may include a containment vessel 110, which may be configured as a crucible, mold, or other receptacle for heating and cooling a melt material 120 disposed therein. To these ends, various characteristics of containment vessel 110, including its material composition, geometry, and dimensions, may be customized, as desired for a given target application or end-use.

In some embodiments, containment vessel 110 may be constructed, in part or in whole, from one or more materials having any (or all) of the following characteristics: (1) high thermal conductivity; (2) low magnetic susceptibility (e.g., magnetically transparent); and (3) high resistance to thermal shock upon quenching (discussed below). Some example suitable materials may include copper (Cu), austenitic stainless steel, and graphite. As will be appreciated in light of this disclosure, the preferred material composition for containment vessel 110 may depend, at least in part, on the material composition of melt material 120 and/or the processing temperature range utilized in processing melt material 120, as described herein.

In some embodiments, such as that illustrated via FIG. 1, containment vessel 110 may be of a generally cylindrical configuration (e.g., a circular or elliptical tube) having a curvilinear (e.g., annular) cross-sectional geometry. In some other embodiments, such as that illustrated via FIG. 2, containment vessel 110 may be of a generally rectangular prismatic configuration (e.g., a square or rectangular tube) having a polygonal (e.g., quadrilateral annular) cross-sectional geometry. Depending on the desired scale of the product resulting from processing of melt material 120, the dimensions (e.g., length, width, diameter, depth, etc.) of containment vessel 110 may be customized. Other suitable configurations for containment vessel 110 will depend on a given application and will be apparent in light of this disclosure.

As will be appreciated in light of this disclosure, any of a wide range of melt materials 120 may be processed, in part or in whole, via system 100. In accordance with some embodiments, melt material 120 may be, for example, an aluminum (Al)-based alloy, a copper (Cu)-based alloy, or any other electrically conductive alloy. In some cases, melt material 120 may be a non-ferrous (e.g., non-ferromagnetic) alloy, though this is not required. In some instances, melt material 120 may be a glass-forming alloy, though this is not required. Other suitable melt materials 120 which may be processed, in part or in whole, by system 100 will be apparent in light of this disclosure.

In accordance with some embodiments, an electrically insulating layer 130 configured to electrically insulate melt material 120 from its containment vessel 110 optionally may be disposed within containment vessel 110. To that end, various characteristics of optional electrically insulating layer 130, including its construction and material composition, may be customized, as desired for a given target application or end-use.

In some embodiments, electrically insulating layer 130 may be a single-layer or multi-layer coating disposed over at least a portion of the interior surface of containment vessel 110. In some other embodiments, electrically insulating layer 130 may be a removable insert configured to be disposed within containment vessel 110, covering at least a portion of the interior surface thereof. In either case, the thickness of electrically insulating layer 130 (e.g., as determined by the distance it extends outward from a given interior sidewall portion of containment vessel 110) may varied, as desired. In some instances, electrically insulating layer 130 may have a substantially uniform thickness over an underlying topography, optionally being provided as a substantially conformal layer over such topography. In other instances, electrically insulating layer 130 may be provided with a non-uniform or otherwise varying thickness over its underlying topography. For example, in some cases a first portion of electrically insulating layer 130 may have a thickness within a first range, whereas a second portion thereof may have a thickness within a different second range. In some instances, electrically insulating layer 130 may have first and second portions having average thicknesses that are different from one another by about 20% or less, about 15% or less, about 10% or less, or about 5% or less. Numerous suitable configurations and variations will be apparent in light of this disclosure.

To provide the desired insulating performance, optional electrically insulating layer 130 may be formed, in part or in whole, from one or more electrically insulating materials. For instance, in some embodiments, optional electrically insulating layer 130 may include a ceramic material, such as aluminum nitride (AlN) or pyrolytic boron nitride (PBN), among others. As will be appreciated in light of this disclosure, the preferred material composition for optional electrically insulating layer 130 may depend, at least in part, on the material composition of melt material 120 and/or the processing temperature range utilized in processing melt material 120, as described herein. Other suitable configurations for optional electrically insulating layer 130 will depend on a given application and will be apparent in light of this disclosure.

To supply electric current through melt material 120, system 100 may include one or more electrodes 140 operatively coupled with a power supply 150 (discussed below). To that end, various characteristics of electrode(s) 140, including their construction, material composition, and arrangement, may be customized, as desired for a given target application or end-use.

In accordance with some embodiments, a given electrode 140 may be configured to physically contact, and thus be electrically coupled with, melt material 120 directly. In some other embodiments, however, a given electrode 140 may be configured to be electrically coupled with melt material 120 indirectly through one or more intervening layers or structures optionally disposed between that electrode 140 and melt material 120. In some embodiments, such as that shown via FIG. 3, a given electrode 140 optionally may be mounted on an end cap 145 configured to be mounted proximate melt material 120, thereby providing electrical coupling (direct or indirect) between that electrode 140 and melt material 120. The configuration and dimensions of end cap(s) 145 may be customized, as well.

In some embodiments, electrode(s) 140 may be constructed, in part or in whole, from one or more electrically conductive materials having a low solubility with respect to melt material 120 at the applied processing temperature range. For example, if melt material 120 includes an Al-based or Cu-based alloy, then electrode(s) 140 may be graphite. As will be appreciated in light of this disclosure, the preferred material composition for electrode(s) 140 may depend, at least in part, on the material composition of melt material 120 and/or the processing temperature range utilized in processing melt material 120, as described herein. Other suitable configurations for electrode(s) 140 will depend on a given application and will be apparent in light of this disclosure.

System 100 further may include a power supply 150 configured to supply electric current to electrode(s) 140 and, thus, melt material 120. In some embodiments, power supply 150 may be an alternating current (AC) power supply configured to provide electrical output having a frequency in the range of about 1-1,000 Hz (e.g., about 1-250 Hz, about 250-500 Hz, about 500-750 Hz, about 750-1,000 Hz, or any other sub-range in the range of about 1-1,000 Hz). Other suitable configurations for power supply 150 will depend on a given application and will be apparent in light of this disclosure.

System 100 also may include one or more magnetic field sources 160 external to containment vessel 110 and configured to immerse melt material 120 (disposed within containment vessel 110) within a magnetic field of a given magnetic field strength. To that end, various characteristics of magnetic field source(s) 160, including their construction, arrangement, strength, and maneuverability, may be customized, as desired for a given target application or end-use.

In some embodiments, a given magnetic field source 160 may be (or otherwise may include) one or more permanent magnets, the magnetic field strength of which may be selected as desired. In some other embodiments, a given magnetic field source 160 may be (or otherwise may include) one or more direct current (DC) electromagnets, the magnetic field strength of which may be adjustable to achieve a desired magnetic field strength. As will be appreciated in light of this disclosure, the preferred quantity and arrangement of magnetic field sources 160 employed by system 100 may depend, at least in part, on the geometry and dimensions (e.g., length; diameter) of containment vessel 110, at least in some cases.

In accordance with some embodiments, a given magnetic field source 160 optionally may be configured to rotate along one or more axes. For instance, in some embodiments, such as that illustrated via FIG. 1, a given magnetic field source 160 may be configured to rotate along a central axis of containment vessel 110. In some embodiments, such as that illustrated via FIG. 2, a given magnetic field source 160 may be configured to rotate along its own central axis. As discussed below, rotation of a given magnetic field source 160 along a given axis may provide for additional and/or different stirring capabilities with respect to processing of melt material 120.

Considering the time-varying nature of the AC, as provided via electrode(s) 140 and power source 150, and the geometrical anisotropy of the AC in the melt material 120, both of those features may carry over to the resulting Lorentz force density when a magnetic field is applied via magnetic field source(s) 160. If melt material 120, as a current-carrying medium, is in a molten state, it cannot sustain shear, with the result being that the Lorentz force will initiate convective currents in the melt system. Moreover, by introducing the magnetic Reynolds number, $$Re_{\delta}=2(L/\delta)^2,$$

where L is the typical dimension (e.g., thickness, diameter, or the like) of the melt material 120, and δ is the skin depth (as previously discussed), a maximum of kinetic energy may be imparted on the liquid melt material 120 when $Re_{\delta}\approx 20$, in accordance with some embodiments. Thus, in accordance with some embodiments, the optimal driving frequency of the AC for purposes of stirring melt material 120 may be a function of: (1) the geometry of the system in question; and (2) the melt material 120, primarily its electrical conductivity in the liquid state.

Thus, in applying AC to melt material 120 via electrode(s) 140 and a static and stationary magnetic field via magnetic field source(s) 160, the sinusoidal nature of the AC will carry over to the Lorentz force, which will oscillate along at least one axis, causing agitation of melt material 120 when molten within containment vessel 110, in accordance with some embodiments. Furthermore, by rotating the applied magnetic field (e.g., by rotating a given magnetic field source 160), still in the plane normal to the AC, the Lorentz force component may be made to oscillate in a plane, as opposed to just in one direction, giving freedom to increase the stirring effect, in accordance with some embodiments. In at least some cases, rotating the applied magnetic field by rotating a given magnetic field source 160 along a given axis may result in more thorough and uniform mixing of melt material 120 than existing melt mixing approaches.

Methodology

Figure 4:
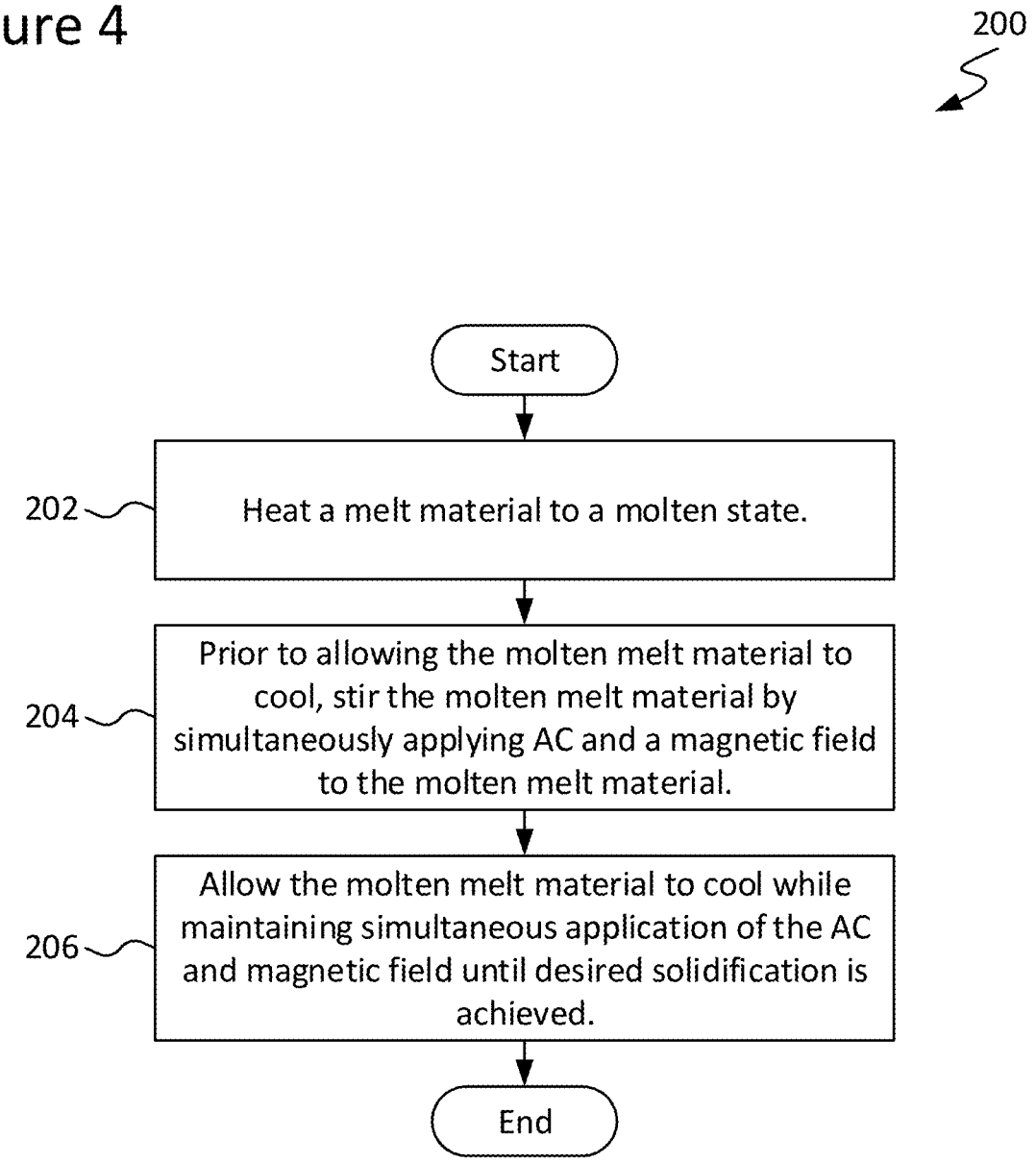
FIG. 4 is a flow diagram illustrating a method of processing a melt material, in accordance with an embodiment of the present disclosure.

FIG. 4 is a flow diagram illustrating a method 200 of processing a melt material 120, in accordance with an embodiment of the present disclosure. As can be seen, the method 200 may begin as in block 202 with heating a melt material 120 to a molten state. To that end, melt material 120 may be placed in containment vessel 110 and heated to sufficient temperature to effectuate melting using any one, or combination, of suitable techniques, as will be apparent in light of this disclosure.

The method 200 may continue as in block 204 with, prior to allowing the molten melt material 120 to cool, stirring the molten melt material 120 by simultaneously applying AC and a magnetic field to the molten melt material 120. The AC may be provided, directly or indirectly, via electrode(s) 140 and power supply 150, in accordance with some embodiments. The magnetic field may be provided via magnetic field source(s) 160, in accordance with some embodiments. In some instances, the magnetic field may be static. In some other instances, the magnetic field may be dynamic, as provided, for example, by rotating one or more of the magnetic field sources 160 along one or more desired axes.

The method 200 may continue as in block 206 with allowing the molten melt material 120 to cool while maintaining simultaneous application of the AC and the magnetic field until a desired degree of solidification is achieved. Cooling of melt material 120 may be provided via any one, or combination, of suitable cooling techniques. For instance, in accordance with some embodiments, containment vessel 110 may be subjected to one or more quenching processes. In accordance with some embodiments, containment vessel 110 may be subjected to direct spraying of a coolant material thereon in a process of quenching molten melt material 120. In accordance with some other embodiments, containment vessel 110 optionally may include one or more (e.g., a network or other plurality) of embedded channels formed therein through which a coolant material may flow in the process of quenching molten melt material 120. In these and other instances, the coolant may be any one, or combination, of suitable temperature control media, including, for example, water, steam, alcohol, or oil, among others. Furthermore, as will be appreciated in light of this disclosure, it may be desirable to ensure that the material composition and overall construction of containment vessel 110 is compatible, to a given degree, with any of these or other quenching techniques.

Once solidification of the melt material 120 within containment vessel 110 is complete, application of the AC and magnetic field to the newly solidified melt material 120 may be reduced or ceased altogether, in accordance with some embodiments.

Figure 5:
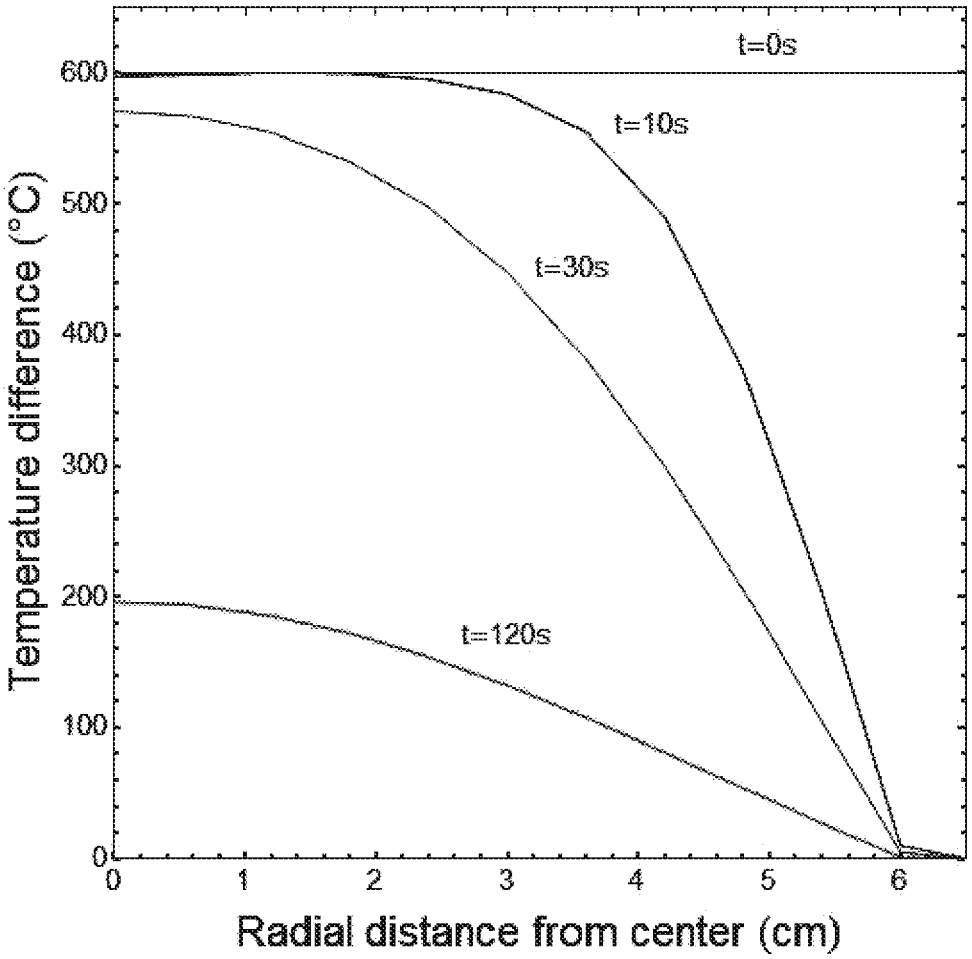
FIG. 5 is an idealized radial temperature profile graph illustrating temperature difference as a function of radial distance from the center of a liquid confined to a cylindrical mold, the liquid initially at some uniform temperature but then cooled by extracting heat from the outside of the mold.

FIG. 5 is an idealized radial temperature profile graph illustrating temperature difference as a function of radial distance from the center of a molten melt material confined to a cylindrical mold, the liquid initially at some uniform temperature but then cooled by extracting heat from the outside of the mold. In this specific example, the cylindrical mold has an inner radius of 6 cm and a sidewall thickness of 0.5 cm. The material properties of this example melt are assumed to be: $\rho$=6.0 g/cm$^3$; $c_p$=0.4 J/gK; and k=0.2 W/cmK. Moreover, the material properties of this example mold are those of copper (Cu): $\rho$=9.0 g/cm$^3$; $c_p$=0.4 J/gK; and k=3.0 W/cmK. The plotted solutions are found by imposing a fixed temperature on the outside mold wall, and the scale on the y-axis is the difference of the melt temperature and this externally imposed temperature.

By stirring the melt of FIG. 5 using techniques disclosed herein, heat would be brought to the mold surface convectively rather than only conductively, and such a scheme would move the limitation on thermal transport from the liquid to the mold and external heat extraction, in accordance with some embodiments. Although the plot of FIG. 5 does not account for the latent heat or the anisotropy of thermal conductivity brought on by solidification of the melt, it does show that significant thermal gradients can be established under typical length scales of castings. If such a melt were to be stirred using techniques disclosed herein, this temperature profile would be approximately uniform, meaning that the heat would be transported to the mold by means of convection rather than only conduction, in accordance with some embodiments. In the extreme case of a perfectly uniform profile together with the boundary condition of a fixed outside temperature, the cooling would be exponential, being between 10-100 times faster than standard conduction cooling approaches, in accordance with some embodiments.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A melt material processing system comprising:

a containment vessel configured to contain a melt material comprising an electrically conductive alloy;

at least one electrode configured to:

be in direct physical contact with the melt material within the containment vessel; and apply an alternating current (AC) directly to the melt material;

a magnetic field source configured to apply a magnetic field to the melt material within the containment vessel, wherein the magnetic field source is configured to rotate along at least one of:

a central axis of the containment vessel; and a central axis of the magnetic field source; and a power supply configured for electrical communication with the at least one electrode to supply the AC applied directly to the melt material;

wherein the AC is of a frequency greater than 440 Hz and less than or equal to 1,000 Hz; and wherein the system is configured to provide stirring of a molten portion of the melt material via interaction between the AC and magnetic field.

2. The system of claim 1, wherein the containment vessel includes at least one exterior channel configured to pass a coolant therethrough.

3. The system of claim 1, further comprising at least one electrically insulating layer disposed within the containment vessel, over at least a portion of an interior surface of the containment vessel, such that the at least one electrically insulating layer intervenes between the melt material and the interior surface of the containment vessel.

4. The system of claim 3, wherein the at least one electrically insulating layer is a removable insert configured to be inserted within the containment vessel.

5. The system of claim 3, wherein the at least one electrically insulating layer comprises at least one of a ceramic material, aluminum nitride (AlN) and pyrolytic boron nitride (PBN).

6. The system of claim 1, wherein the magnetic field source comprises at least one of:

at least one permanent magnet; and at least one direct current (DC) electromagnet.

7. The system of claim 1, wherein the magnetic field source is configured to rotate along both of:

the central axis of the containment vessel; and the central axis of the magnetic field source.

8. The system of claim 1, wherein the system is further configured to provide Joule heating of the melt material within the containment vessel via the at least one electrode.

9. The system of claim 1, wherein the system is further configured to provide for maintenance of a constant Lorentz force density by increasing a magnitude of the magnetic field while reducing a magnitude of the AC.

10. The system of claim 1, wherein the system is further configured to provide for heat transfer from the molten portion of the melt material to the containment vessel by both convection and conduction.

11. The system of claim 10, wherein the heat transfer provided by the system is between 10-100 times faster than heat transfer by conduction only.

12. The system of claim 1, wherein the AC is of a frequency greater than or equal to 450 Hz and less than or equal to 1,000 Hz.

13. A method of processing a melt material, the method comprising:

heating the melt material to a molten state within a containment vessel, the melt material comprising an electrically conductive alloy;

prior to allowing the molten melt material to cool, stirring the molten melt material by simultaneously:

applying alternating current (AC) directly to the molten melt material via at least one electrode in direct physical contact with the molten melt material, wherein the AC is of a frequency greater than 440 Hz and less than or equal to 1,000 Hz; and applying a magnetic field to the molten melt material, wherein a source of the magnetic field is rotated along at least one of:

a central axis of the containment vessel; and a central axis of the magnetic field source; and allowing the molten melt material to cool while maintaining application thereto of the AC and the magnetic field.

14. The method of claim 13, wherein the containment vessel includes at least one exterior channel configured to pass a coolant therethrough.

15. The method of claim 14, wherein allowing the molten melt material to cool comprises:

passing the coolant through the at least one exterior channel.

16. The method of claim 15, wherein the at least one exterior channel is embedded in the containment vessel.

17. The method of claim 13, wherein the magnetic field is applied via at least one of:

at least one permanent magnet; and at least one direct current (DC) electromagnet.

18. The method of claim 13, wherein in applying the magnetic field to the molten melt material, the source of the magnetic field rotates along both of:

the central axis of the containment vessel; and the central axis of the source of the magnetic field.

19. The method of claim 13, wherein allowing the molten melt material to cool comprises:

quenching the molten melt material by applying a coolant to at least a portion of an exterior of the containment vessel.

20. The method of claim 13, wherein allowing the molten melt material to cool comprises:

spraying a coolant on the containment vessel.

* * * * *